US008493421B2

(12) United States Patent
Pettersson et al.

(10) Patent No.: US 8,493,421 B2
(45) Date of Patent: Jul. 23, 2013

(54) METHOD AND ARRANGEMENT FOR MANUFACTURING PACKAGES IN A DIGITALLY CONTROLLED PROCESS

(75) Inventors: Jonas Pettersson, Turku (FI); Petri Sirviö, Imatra (FI); Marko Ryynänen, Pulp (FI); Juha Lehtola, Raisio (FI)

(73) Assignee: Tresu A/S, Bjert (DK)

( * ) Notice: Subject to any disclaimer, the term of this patent is extended or adjusted under 35 U.S.C. 154(b) by 265 days.

(21) Appl. No.: 12/989,332

(22) PCT Filed: Apr. 24, 2009

(86) PCT No.: PCT/FI2009/050325

§ 371 (c)(1),
(2), (4) Date: Dec. 29, 2010

(87) PCT Pub. No.: WO2009/130393

PCT Pub. Date: Oct. 29, 2009

(65) Prior Publication Data

US 2011/0122212 A1 May 26, 2011

(30) Foreign Application Priority Data

Apr. 24, 2008 (FI) ..... 20085356

(51) Int. Cl.
*B41J 2/00* (2006.01)
*B31B 1/00* (2006.01)

(52) U.S. Cl.
USPC ..... 347/110; 347/900; 493/8

(58) Field of Classification Search
USPC ..... 347/110, 900; 493/8, 11, 53, 56
See application file for complete search history.

(56) References Cited

U.S. PATENT DOCUMENTS

| | | | |
|---|---|---|---|
| 5,816,994 | A | 10/1998 | Hill et al. |
| 6,484,475 | B1 | 11/2002 | Neagle et al. |
| 6,604,017 | B1 | 8/2003 | Richardson et al. |
| 2004/0001219 | A1 | 1/2004 | Wen et al. |
| 2004/0166238 | A1 | 8/2004 | Nowicki et al. |
| 2005/0247173 | A1 | 11/2005 | Alsten et al. |
| 2006/0284360 | A1 | 12/2006 | Hume et al. |
| 2007/0220828 | A1 | 9/2007 | Woodman et al. |

FOREIGN PATENT DOCUMENTS

| | | | |
|---|---|---|---|
| CA | 2 409 330 | A1 | 11/2001 |
| DE | 10 2005 032 014 | B4 | 3/2009 |
| EP | 1 527 871 | A1 | 5/2005 |
| IE | 980179 | A2 | 7/1998 |
| JP | 2-116456 | A | 5/1990 |
| JP | 2-289398 | A | 11/1990 |
| JP | 32022258 | A | 9/1991 |
| JP | 8-230843 | A | 9/1996 |

(Continued)

OTHER PUBLICATIONS

Finnish Search Report for FI 20085356 dated Mar. 4, 2009.

(Continued)

*Primary Examiner* — Omar Rojas
(74) *Attorney, Agent, or Firm* — Birch, Stewart, Kolasch & Birch, LLP

(57) ABSTRACT

Packages are manufactured in a digitally controlled process. A digital printing machine (101) produces printed work-pieces and a cutting machine (104) cuts packaging blanks (105) from them. A conveyor line (107) transfers the printed work-pieces automatically from the digital printing machine (101) to the cutting machine (104). A digital control system (109) exchanges digital control information with at least the digital printing machine (101) and the cutting machine (104).

16 Claims, 6 Drawing Sheets

FOREIGN PATENT DOCUMENTS

| | | | |
|---|---|---|---|
| JP | 2556680 | B2 | 9/1996 |
| JP | 9-253985 | A | 9/1997 |
| JP | 10-264273 | A | 10/1998 |
| JP | 2000-117594 | A | 4/2000 |
| JP | 2003-231244 | A | 8/2003 |
| JP | 2005-67624 | A | 3/2005 |
| JP | 2006-150735 | A | 6/2006 |
| JP | 2007-334733 | A | 12/2007 |
| WO | WO 00/46102 | A1 | 8/2000 |

OTHER PUBLICATIONS

International Search Report for PCT/FI2009/050325 dated Oct. 5, 2009.

Office Action dated Mar. 19, 2013 for corresponding Japanese Patent Application No. 2011-505544.

METHOD AND ARRANGEMENT FOR MANUFACTURING PACKAGES IN A DIGITALLY CONTROLLED PROCESS

TECHNICAL FIELD

The invention relates to the manufacture of packages in a process that includes at least printing and cutting stages. Especially, the invention relates to the integration of such a manufacturing process into a complex, the centralized digital control of which provides flexibility and reliability and enables a product-specific verification and authentication.

PRIOR ART AND BACKGROUND OF THE INVENTION

Generally, product packages are manufactured from cardboard and similar materials, which can be processed as webs or sheets and on which colours, figures and symbols can be printed in a printing machine. In addition to printing, the manufacturing of the package can include surface treatment and cutting stages, folding, applying of size and other stages.

The printing that is included in the package manufacturing has conventionally been carried out by the offset technology that has well-known advantages, such as a uniform and high print quality, a relatively easy and quick manufacturing of the printing plates, and the long useful life of the plates. As an extension to the printing machine, there can be a lacquering stage, wherein the surface of the printed material is protected and it is given its desired final appearance either by using a water-thinnable or soluble lacquer. Other types of surface treatments are also feasible. At the following stage, package blanks are cut out of the printed material by a die-cutting press, and the creases, required by folds, are made. Size is applied on desired spots of the blanks and they are folded into their final form at the end of the manufacturing process.

One disadvantage of the conventional manufacturing process of the packages is its poor applicability to manufacturing of individual pieces or small series. It is difficult or impossible to join to the printing plates of the offset technology any part, which would produce varying figures. For example, the pharmaceutical industry needs packages, which can be individualized at an accuracy of a single package to enable the traceability required by the product liability, and so that the features of the package could be used to further the follow-up of the distribution chains and to distinguish original products from counterfeits. Providing the packages with individual identifiers in printing plants that use the offset technology has required the use of a separate inkjet, matrix or other printhead, in addition to the actual printing machine.

The pharmaceutical industry is also a good example of a client of the packaging industry that demands a high safety level. Different packages are not allowed to mix during the manufacturing process, so that no products packed in a misleading way would end up in the distribution and consumers' hands. The strictest safety regulations require that when the type of package produced on a production line changes, the workers must empty the machines and their surroundings of the materials related to the previous type of package before bringing in new materials. Moving the materials causes down time that is unproductive for the production, decreasing the effectiveness of the manufacturing; particularly, if the batches to be produced are relatively small.

BRIEF SUMMARY OF THE INVENTION

The object of the present invention is to provide a method and an arrangement for manufacturing packages, so that the manufacture of single pieces and small series is quick, smooth and safe. Another object of the present invention is to improve the possibilities of the packaging industry to support the traceability and authentication of the products. A further object of the invention is to provide methods and arrangements for employing modular solutions on the production line of packages, so that the line can be flexibly designed and constructed to serve various purposes, wherein the high quality and safety requirements set for the packages and smooth production are emphasized.

The objects of the invention are achieved by assembling the production line of the packages from digitally controlled modules, which are capable of producing, distributing and/or utilizing digital control information at an accuracy of a single work-piece.

The manufacturing arrangement of packages according to the invention is characterized in that the arrangement comprises:

- a digital printing machine for producing printed workpieces,
- a cutting machine for cutting package blanks from the printed workpieces,
- a conveyor line for automatically transferring the printed workpieces from said digital printing machine to said cutting machine, and
- a digital control system, which is arranged so as to transmit digital control information at least between said digital printing machine and said control system, and between said cutting machine and said control system.

The manufacturing method of packages according to the invention is characterized in that the method comprises:

- producing printed workpieces by a digital printing machine,
- conveying the produced printed workpieces from the digital printing machine to a a cutting machine automatically,
- cutting package blanks from the printed workpieces, and
- transmitting digital control information between said digital printing machine and a control system and between the cutting machine and said control system.

The digital printing machine has the feature known as such that even in series production it can produce individually changing prints and parts of prints, such as identifiers. A less known thing is that the digital control of the printing process also comprises other production and use of the control information that can be individualized at the accuracy of a single workpiece, when needed. For example, the digital printing machine can measure the success of alignment and, at the accuracy of a single printed sheet, store information about where the print fell on a sheet. The original use of the alignment information relates to the inner automatic adjustments of the digital printing machine, but if it is transmitted out of the printing machine, it can be utilized in the other stages of the manufacturing line, for example, in controlling the cutting or another subsequent processing stage.

When there are several stages on the manufacturing line of the packages, such as printing and cutting, other advantages are also achieved by the common digital control. The mutually different products may not necessarily need to be manufactured in separate runs, but the machines of the manufacturing line, which perform the various stages, can change their functioning smoothly during the run according to what kind of control information they are given and what kinds of observations they independently make, for example, by reading the identifiers printed on the workpieces. Through the centralized control, information generated at one stage of the process can be forwarded in advance, so that any of the subsequent working phases can be prepared for the coming change well before the first workpiece requiring the change arrives at the said subsequent working phase. Correspondingly, information generated at one stage of the process can also be transmitted backwards, for example, so that new workpieces are automatically prepared to replace those that have been removed from the process in midstream because of a defect. The centralized control can follow the advance of production lots and even single workpieces in the manufacturing process. It can be used to ensure, both during and after the manufacture that a correct number of workpieces have passed through each working phase in the right order.

The centralized digital control of the manufacturing line of packages provides many advantages. The manufacture of packages turns into a continuous process that works on the on-demand principle, from creating a work file all the way to individually identifiable end products, wherein the end products are packaging blanks, which have been subjected to at least one of the following operations: printing, cutting, creasing, sizing and folding. The process requires neither intermediate phases that are carried out by hand nor separate intermediate storing or moving of the products from one machine to another. The decrease in extra removals of items, interruptions and adjustment work saves time and energy, due to which the carbon footprint of the manufacturing process of the packages becomes smaller than previously.

BRIEF DESCRIPTION OF THE DRAWINGS

In the following, the invention is described in detail with reference to the preferred embodiments, which are presented by way of an example, and the appended drawings, wherein.

DETAILED DESCRIPTION OF THE INVENTION

Figure 1:
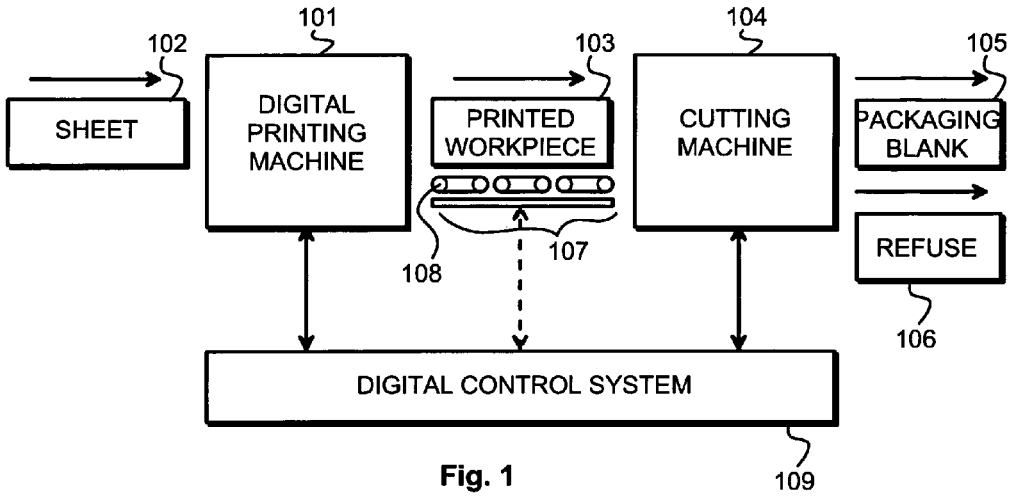
FIG. 1 shows a principle of a digitally controlled arrangement that is used for manufacturing packages.

FIG. 1 shows schematically an arrangement according to an embodiment of the invention for manufacturing packages in the digitally controlled process. The arrangement comprises a digital printing machine 101 for producing printed work-pieces. At the moment of writing this text, a typical digital printing machine is a sheet-fed machine based on electrophotography, but the invention is neither limited to a specific printing technique nor to the printing machine handling sheets merely. Regarding individual versatility, the most essential functional feature of the digital printing machine 101 is that it receives electric input information and as a result is capable of producing individually printed workpieces.

When the packages are manufactured, it could be assumed that the majority of prints produced by the digital printing machine 101 remain the same from one workpiece to another throughout a specific production series, but an individual identifier part can be printed on each workpiece. In order to easily utilize the information conveyed by the individual identifier part at the subsequent mechanical processing stages of the workpiece and/or the package that is later on made of the same, it preferably contains a machine readable identifier, such as a character string, bar code, two-dimensional bar code or another machine readable code. If the digital printing machine 101 is capable of handling electrically conductive printing inks, these can even be used to form on the workpieces electrical printed circuits, which can be fully or partly individual.

As an assumption about the sheet-fed machine was made above, the piece of raw material that is fed into the digital printing machine 101 can be called a sheet 102. The piece coming out is a printed workpiece 103.

The arrangement according to FIG. 1 can contain a variety of working phases after the printing. Typically, the packages made of the material to be printed require a cutting stage, wherein packaging blanks are cut from the printed workpieces that are generally in the form of square sheets or a continuous web. The cutting can be carried out, for example, by a die-cutting press that comprises a die-cutting tool consisting of two plate-like parts. The cutting can also be carried out by a laser, water or steam jet, air jet, controllable cutting tip or another cutting instrument. Due to the diversity of the working method alternatives available, the machine 104 of FIG. 1 is generally called a cutting machine. It is arranged to take in printed work-pieces 103 and produce cut packaging blanks 105 from them. The cutting also produces refuse 106, which exits the process through a refuse removal treatment (not shown in FIG. 1). In particular, if the cutting machine is a die-cutting press, formation of conductive figures or those used for appearance purposes from heat-sealable or cold-sealable foil on the surface of the workpieces can be combined therewith, the foil being fed between the plates of the die-cutting tool in a suitable manner.

One printed workpiece can be turned into one or more packaging blanks. There can be one identifier produced by the digital printing machine per printed work-piece or, more preferably, one per packaging blank. Several identifiers per printed workpiece and/or several identifiers per packaging blank can also be used. In that case, the identifiers can utilize the same technology (e.g., two bar codes in different parts of the package blank) or they can be completely different (e.g., a bar code printed with an ordinary ink and an electric circuit printed with a conductive ink). The identifiers can have different levels of hierarchy, e.g., so that a printed workpiece has an identifier of its own and the packaging blanks cut from the work-piece each have theirs, or that the packaging blanks cut from the same printed workpiece each have a common part, which individualizes the printed workpiece, and a specific part, which individualizes the packaging blank that is cut from the printed workpiece in question.

For transferring the printed workpieces 103 automatically from the digital printing machine 101 to the cutting machine 104, the arrangement of FIG. 1 comprises a conveyor line 107. Its detailed implementation is not essential for the general principle of the invention, but certain major advantages can be achieved by assembling the conveyor line 107 from digitally controlled conveyor modules 108. FIG. 1 also shows schematically a digital control system 109, which has information lines with at least the digital printing machine 101 and the cutting machine 104 and, typically, also with the conveyor line 107. The digital control system 109 is arranged so as to transmit digital control information along these information lines. Typically, the digital control system 109 is also arranged to store information of the identifiers that have been read on the printed workpieces handled by the arrangement and/or on the packaging blanks in the different parts of the arrangement, according to the information obtained from the identifier readers. We will return to the contents and use of the digital control information later on in this description. The physical implementation of the information lines is not essential for the invention. The connections can be implemented, e.g., with optical or electric cables or they can be wireless.

Figure 2:
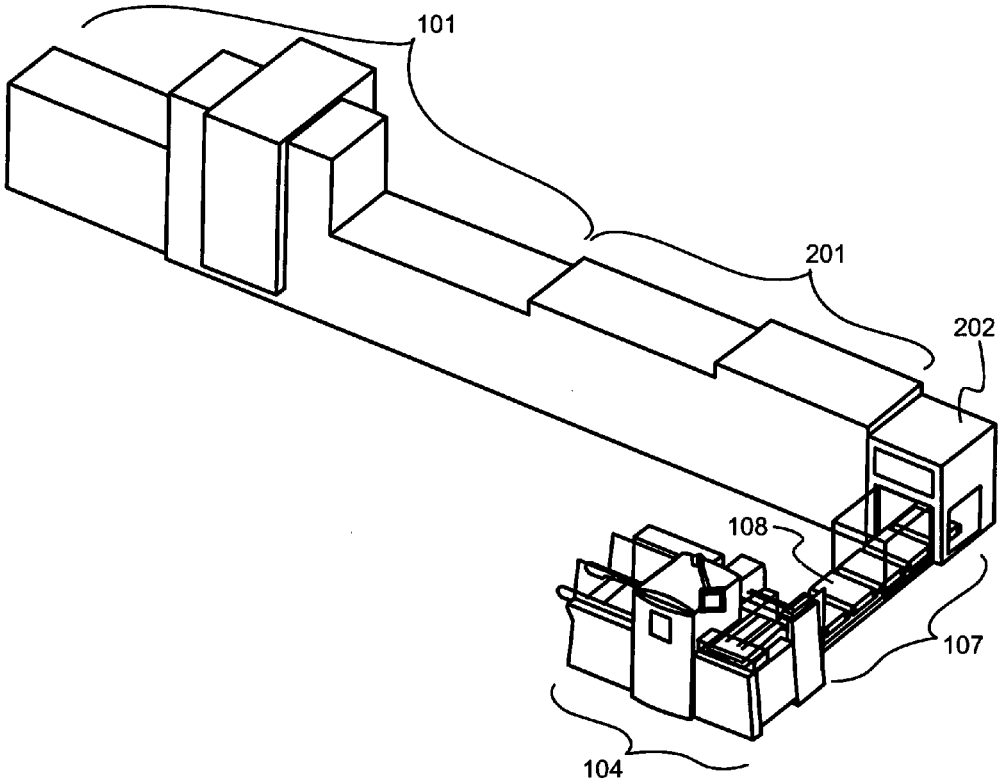
FIG. 2 shows an arrangement for manufacturing packages in a digitally controlled process.

FIG. 2 is an axonometric projection, which shows an arrangement according to the second embodiment of the invention for manufacturing packages in the digitally controlled process. Also this arrangement comprises the digital printing machine 101, cutting machine 104 and conveyor line 107. Furthermore, the arrangement comprises a coating unit 201, which lies after the digital printing machine and is arranged to apply a protecting and finishing coat of lacquer on the surfaces of the printed workpieces. After the coating unit 201, the arrangement comprises a stacker 202, which is arranged to collect the surface-treated printed workpieces in stacks. The completed stacks move along the conveyor line 107 to the cutting machine 104. The conveyor line 107 is assembled from conveyor modules 108. Further processing stages, which are not shown in FIG. 2 but which in the arrangement would easily be located after the cutting machine 104, include refuse removal, application of size and folding.

Examples of digital printing machines, which can be used in the arrangement according to FIG. 2, include the DocuColor and DocuTech printing machines manufactured by the Xerox Corporation. Examples of the cutting machines, which can be used in the arrangement according to FIG. 2, include the Kama ProCut die-cutting presses manufactured by Kama GmbH.

Generally, folding the package mechanically into its final form requires creasing, which is carried out before the folding stage and which can be carried out in a separate creasing machine or be combined with the cutting or folding machines. As the advantages of the digitally controlled arrangement are brought out the best, if all of its stages use the technology suitable for the automatic handling of individual pieces, one preferred solution is to use a water cutter both as the cutting machine and the creasing machine. In that case, the water cutter is arranged to use a relatively high-speed water jet for cutting the packaging blanks from the work-pieces, and a considerably lower-speed water jet and/or a protective coating, which is placed between the water spray head and the workpiece and which stops the water jet, for making the creases. Another example of a creasing method, which is suitable for treating single pieces, is to use a digitally controlled creasing wheel or a pin-like creasing head. The head can have a bearing part, similar to the writing head of a ball-point pen.

The capacity (workpieces handled per a time unit) of a cutting machine that employs the die-cutting technology, in particular, can be considerably higher than that of a digital printing machine, the technique of which is known at the moment of writing this text. The difference in capacity can be exploited, so that any stage of the process between the printing and die-cutting is used as a buffer, which is arranged to temporarily store the printed workpieces, e.g., for the time of changing the die-cutting tool, so that they do not exit the scope of the digitally controlled process for the time of the temporary storage. The buffer is arranged to feed the temporarily stored, printed workpieces forward, when the die-cutting stage is operating again. The centralized digital control makes the fully automatic buffering possible: switching off the die-cutting machine produces a piece of control information, on the basis of which the digital control system transmits to the buffer stage instructions to start buffering. Correspondingly, restarting the die-cutting machine produces another piece of control information, on the basis of which the digital control system transmits to the buffer stage instructions to start feeding forward the temporarily stored printed workpieces.

In the arrangement according to FIG. 2, the buffer consists of the stacker 202 and the conveyor line 107. The stacker 202 is arranged to collect the printed work-pieces, which come from printing and lacquering, in stacks that move forward on the conveyor line 107 one stack at a time. The maximum number of printed work-pieces that are to be buffered is obtained by dividing the length available to the conveyor line 107 by the length of the stack (whereby the number of stacks accommodated on the conveyor line 107 one after the other is obtained) and by multiplying this provisional result by the greatest possible number of workpieces that a single stack can contain.

In the arrangement according to FIG. 2, the production line forms a 90 degree angle sidewards at the location of the stacker 202 and the cutting machine 104. The line could also extend directly at the location of these machines or turn by another degree to another direction. However, the 90-degree sideward turn according to the figure provides some advantages. When coming from printing and lacquering, the printed workpieces are typically rectangular, proceeding in the process in a position, where their front edge is perpendicular to the direction of propagation. In that case, it is easy to place in the stacker 202 two edge guides (not shown in the figure) that are perpendicular to each other, one of which stops the movement of the printed workpiece, when the said front edge hits the stopping edge guide. One of the sides of the workpiece, which were in the direction of propagation, is set in the direction of the other edge guide that is perpendicular to the stopping edge guide. When a stack of a specific highness of printed workpieces that stop in this place and position has accumulated, it is easy to transfer away from the stacker by moving it sideward, i.e., in the direction of the stopping edge guide to the side that has no edge guide. Corresponding guide arrangements can be constructed in the feeding section of the cutting machine 104.

Figure 3:
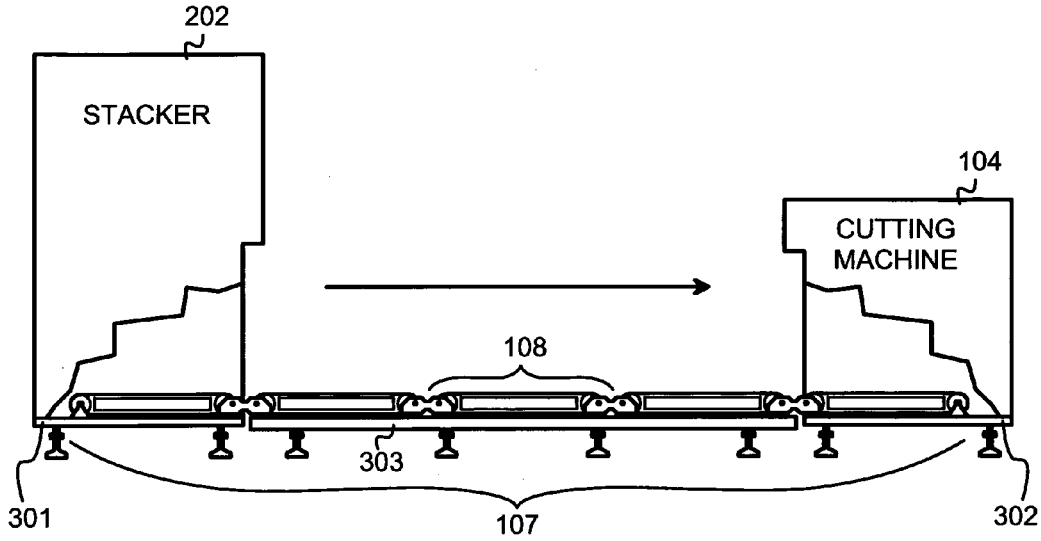
FIG. 3 shows a principle of a conveyor line according to an embodiment of the invention.

FIG. 3 shows schematically a digitally controlled conveyor line 107. It consists of standard-size conveyor modules 108, five of which are placed one after the other in this example. In the figure, the primary direction of movement of the workpieces on the conveyor line 107 is from left to right. The first conveyor module with respect to the direction of movement is located on top of the base plate 301 of the stacker 202, whereby the stack collected by the stacker 202 is formed directly on top of the first conveyor module. The last conveyor module with respect to the direction of movement is placed on top of the base plate 302 of the cutting machine 104, whereby it functions as the feeding base of the cutting machine 104. Between the stacker 202 and the cutting machine 104, there is the base 303 of the conveyor line, on top of which the other conveyor modules are located. Locating the conveyor module floatingly in the structures of another machine (e.g., the stacker or the cutting machine) is preferable, as then the alignment of the workpieces in a place and position proper for the operation of the machine in question is easy to carry out, regardless of how the other part of the conveyor line is located and how the workpieces otherwise move on the conveyor line.

Figure 4:
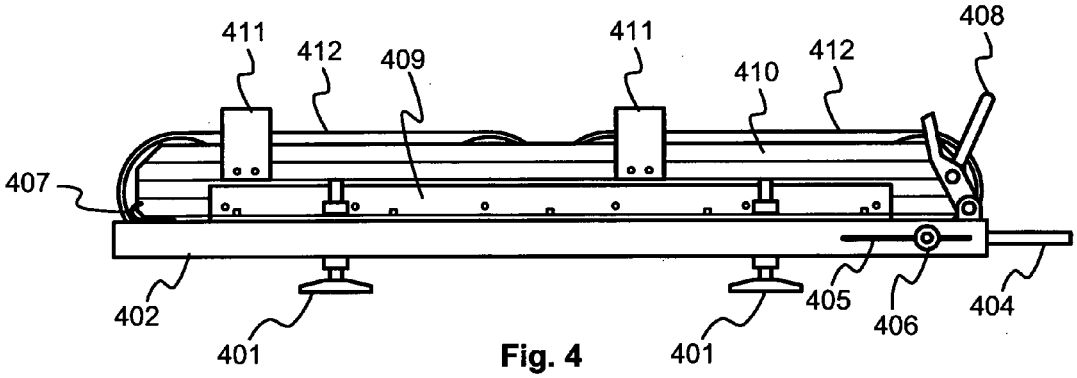
FIG. 4 is a side view of a module suitable for the conveyor line of FIG. 3.
Figure 5:
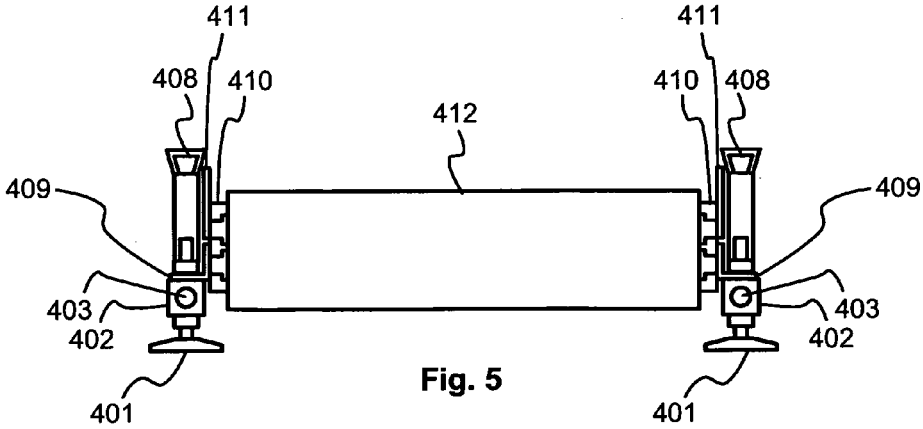
FIG. 5 is a front view of the module of FIG. 4.

FIGS. 4 and 5 show in detail a conveyor module example as a side view (FIG. 4) and a front view (FIG. 5). This conveyor module does not need a separate base, but it comprises legs 401 that are attached to the longitudinal supporting tubes 402 of the conveyor module, which in the figure have a square cross section. In addition to or in place of the legs, wheels could be used, whereby the module would be easier to move. One end of each supporting tube comprises a hole 403 and the other end comprises a pin 404 with a cross section suitable for the hole. When placing the modules one after the other, their mutual alignment can be ensured by inserting the pins into the holes at the ends of the successive modules that come against each other. The figure shows an easy way of making the pin 404 retractable and adjustable as to its length by using an elongated hole 405 that is made on the side of the supporting tube and a clamping screw 406 that moves therein and can be tightened. For vibration not to separate the modules of the completed conveyor line from each other during use, it is worthwhile to interlock them by an easy-to-use manner. FIGS. 4 and 5 show an example of a quick locking that consists of a hook 407 at one end of the supporting tube and a hinged loop 408 at its other end, the loop corresponding to the hook and being provided with a locking lever. Other types of locking can also be used.

Each supporting tube 402 has, by means of an L-profile 409, an E-profile 410 attached thereto, which extends on the side of the module almost throughout the length of the module. The grooves that belong to the E-profile are outside the outer sides of the module, which makes it easier to provide various attachments on the sides of the module. For example, the L-profiles 409 and the identifier holders 411 are attached to the grooves of the E-profiles by screws, which fit through the narrow part of the groove, their corresponding screws being in the wide part of the groove. To perceive the shape and position of the E-profile 410 more easily, the screws are not shown in FIG. 5. Photocells or other identifiers (not shown) can be installed in the identifier holders 411, identifying the existence and/or movement of the stacks on the conveyor module and transmitting the electric signals that correspond to the identification to the control logic of the conveyor module (not shown). As the grooves of the E-profiles 410 extend on the sides of the module almost throughout the length of the module, a desired number of identifier holders 411 can be used and they can easily be attached to suitable spots in the longitudinal direction of the module. A stepless attachment, based on screws that are tightened to the grooves of the E-profile, gives an opportunity to very accurately select the locations where the identification takes place in the longitudinal direction of the module.

As the part that transfers the items to be conveyed, the conveyor module comprises one or more belts 412. The module example described herein comprises two sequential belts 412. The motor(s), belt pulleys and other parts that are needed to move the belts are provided inside the module in the space that remains inside the space defined by the belt(s). The same space also contains the electric circuits required by the power supply and the control logic of the module. The E-profiles 410 can be provided with a suitable number of holes, connectors and similar parts for arranging the power supply and information transfer between the module and the other parts of the system.

Figure 6:
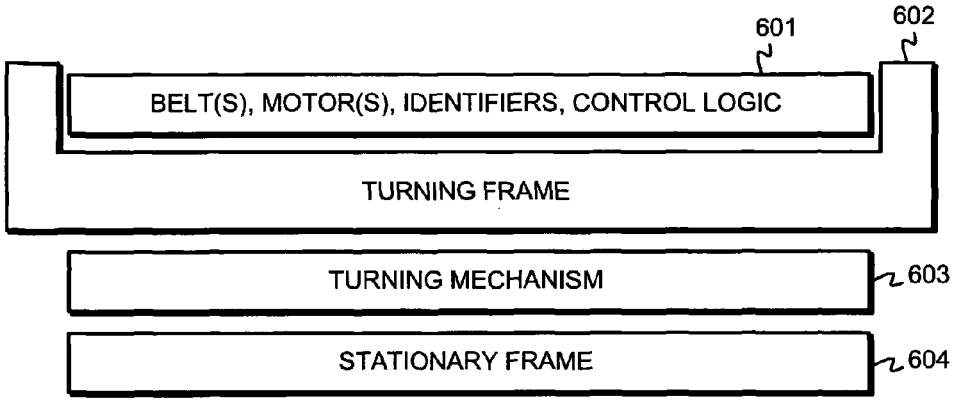
FIG. 6 shows a principle of a module capable of turning stacks.

FIG. 6 shows a principle that can be used to provide a turnover in the modular conveyor line by making minor changes in one module only. The two uppermost parts shown in FIG. 6 can be essentially similar to those in FIGS. 4 and 5: The block 602 can contain the supporting tubes 402 shown in FIGS. 4 and 5 (without the pins and quick lockings used for the connection with the other modules), L-profiles 409, E-profiles 410 and identifier holders 411. The block 601 can contain the belt 412 and the motors, belt pulleys, control logic and other functional parts, to which reference was made above but which are not shown in FIGS. 4 and 5. Below the turning frame 602, there is a turning mechanism 603 and below that, a stationary frame 604, which supports the turning module to the base and comprises the holes, pins and quick lockings needed for the attachment with the adjacent modules.

Figure 7:
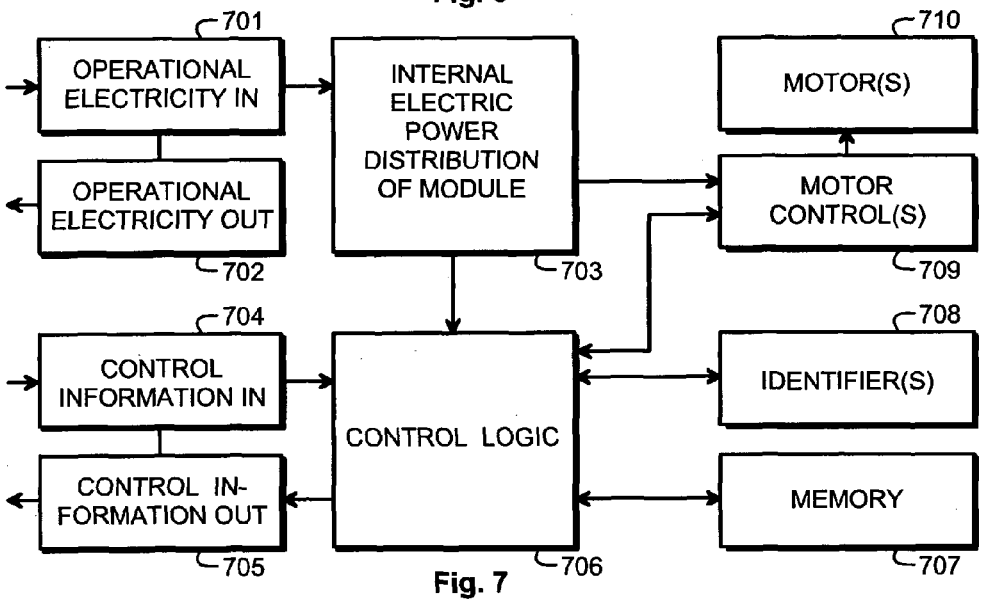
FIG. 7 shows a functional flow chart of a conveyor module.

FIG. 7 shows an example of a functional flowchart of the conveyor module. For introducing the operational power, the block 701 comprises the connectors required. To easily provide a conveyor line of an arbitrary length from the modules, it is preferable to be prepared to chain the connections. Therefore, there is a direct connection from the input block 701 of the operational power to the corresponding output block 702 of the operational power. The power distribution block 703 is arranged to distribute electric power to the parts of the module that need electricity. For transmitting the control information, the module comprises the connectors needed for connecting to a certain control information bus. The example of FIG. 7 shows a separate input block 704 and output block 705 of the control information, but it is obvious that the connection to the control information bus can also take place through one two-way connection block only.

An essential controlling part of the module consists of a control logic 706, which can be, for example, a programmable logic circuit or a simple microprocessor. FIG. 7 shows separately the memory 707 that is available to the control logic, the control logic 706 being able to use the program stored in the memory, and when needed, the memory can also be used as an intermediate storage for the identifiers, measurement information and similar information, which have been read. The identifier block 708 that is connected to the control logic 706 may contain, for example, photocells, limit switches and other sensors, through which the control logic 706 is arranged to receive information about the operation of the module, the position and movements of the items that are conveyed and other necessary factors. Furthermore, the control logic 706 is arranged to give control instructions to the control block 709 of the motor(s), which controls the motor(s) in block 710.

Figure 8:
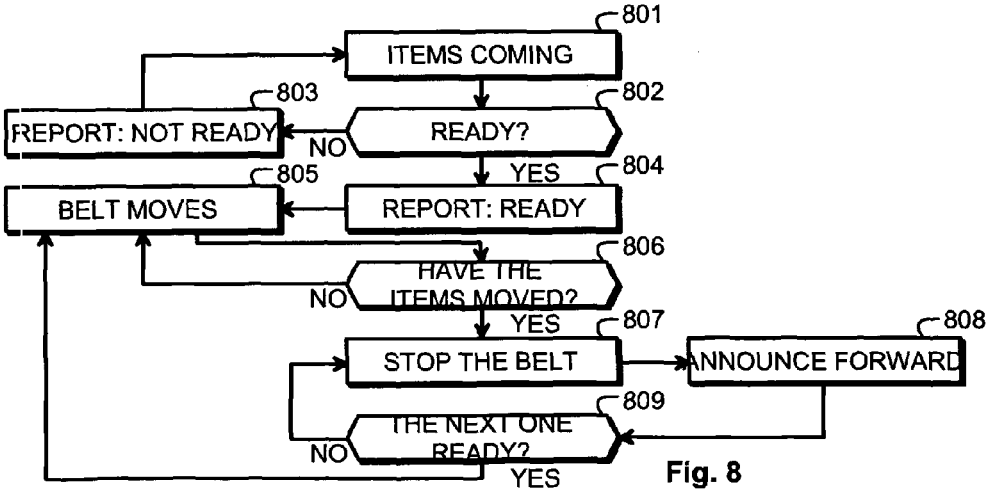
FIG. 8 shows a method of controlling the operation of the conveyor module.

FIG. 8 shows a simple example of a program that can be executed by the control logic of the conveyor module. Controlled by the program, the conveyor module is arranged to exchange, with the other conveyor modules, information about the readiness of the conveyor module to receive items that are to be conveyed and/or to forward the items that are to be conveyed. In space 801, the control logic receives a message through the control information bus from the module preceding that conveyor module, saying that the items to be conveyed are coming. In space 802, the control logic examines, whether that conveyor module is at the moment ready to receive the items to be conveyed; e.g., whether that conveyor module is free from previously conveyed items. If not, the control logic gives a negative message to the previous module through the control information bus in space 803 and moves back to the space 801. If the conveyor module is ready to receive the items to be conveyed, the control logic gives a positive message to the previous module through the control information bus in space 804 and actuates the motor(s) that move(s) the belt in space 805. In space 806, the control logic examines, whether the items have moved as desired, e.g., whether the photocell on the edge on the side of the previous module has first reported about the beam of light breaking and then again about a free passage of the beam. If this condition has not yet been fulfilled, the control logic continues to move the belt in space 805. When the items have moved as desired; in this case, when the items have been received in the conveyor module in question, the belt is stopped in space 807.

For the items that are conveyed to move forward, the control logic gives to the next module, through the control information bus, a message about the items in space 808 and examines in space 809, whether the next module reports being ready. If it is not ready, the control logic returns to space 807. When the next module reports being ready, the control logic starts the motor(s) in the space 805 and then again goes around the loop formed by the spaces 805 and 806, until the items have moved as desired (e.g., until the photocell on the edge of the side of the next module has first reported a beam of light breaking and then again about a free passage of the beam). Thereafter, the execution of the program ends at stopping the belt in space 807 and the control logic is ready to execute the same program again.

Naturally, the program shown in FIG. 8 is a very simple example only and it could be diversified in various ways, e.g., by connecting thereto various emergency management functions, by also being prepared to transfer backwards the items to be conveyed on the conveyor line, by programming the conveyor module so as to read a machine-readable identifier on the conveyed items, by arranging special functions for the conveyor module of the conveyor line that works the first or the last, and so on. The way to make such additions, changes and diversifications is obvious to those skilled in the art as such in the light of this description.

Figure 9:
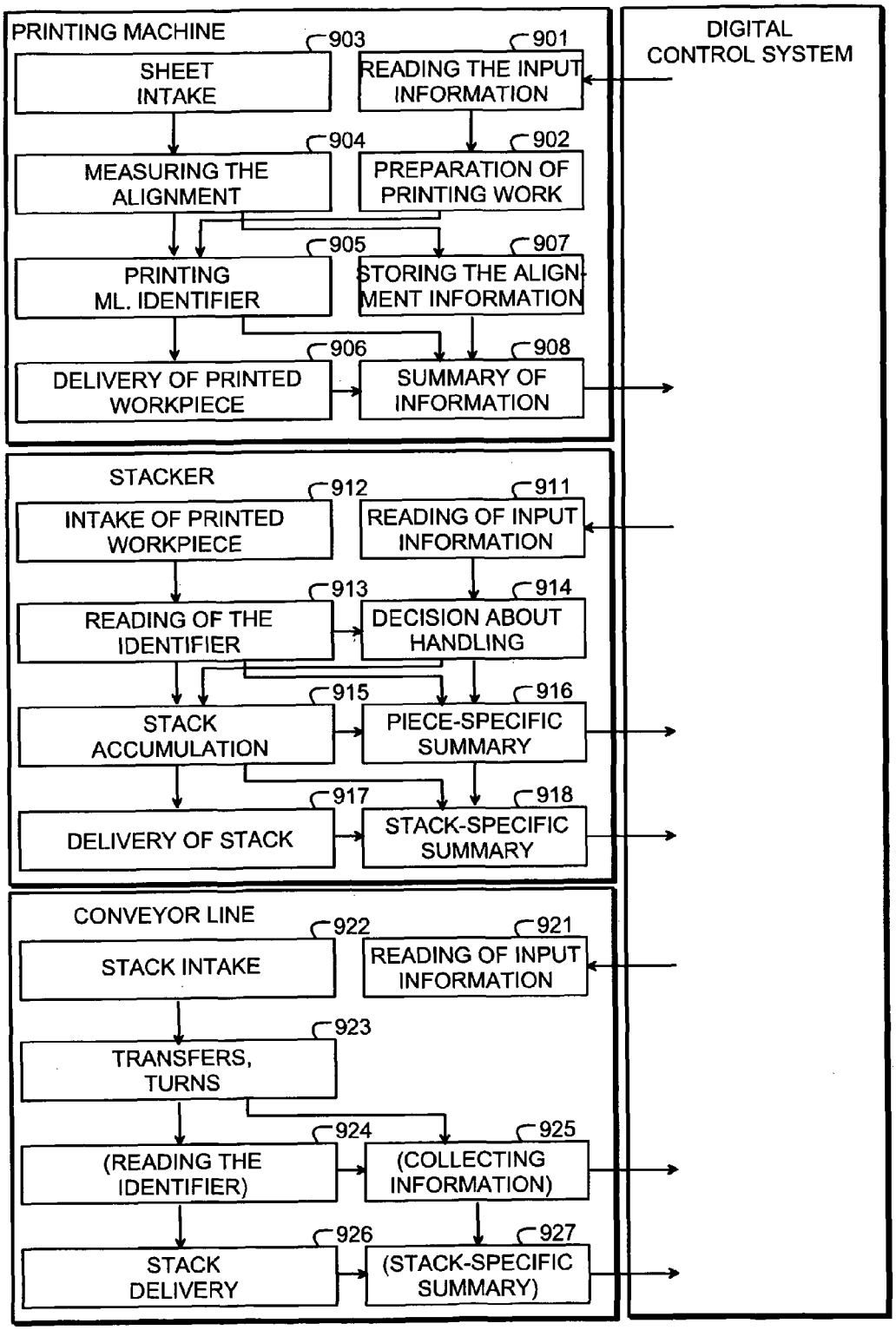
FIG. 9 shows a part of the method according to an embodiment of the invention for manufacturing packages in the digitally controlled process.
Figure 10:
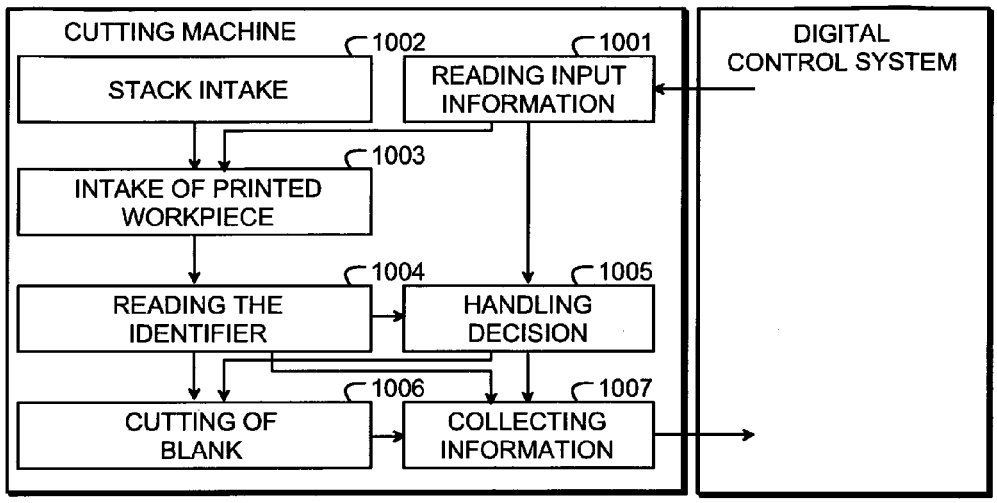
FIG. 10 shows the end part of the method of FIG. 9.

FIGS. 9 and 10 show a method according to an embodiment of the invention for manufacturing packages in the digitally controlled process. The figures show the implementation of certain exemplary process stages in the printing machine, stacker, conveyor line and cutting machine. Under each unit, the left column contains stages that belong to the physical handling of the workpiece and the right column contains stages that belong to the control of activities. At stage 901, the printing machine receives a work file as input information from the digital control system. The work file contains information about how many and what kinds of printed workpieces the printing machine should produce in the run in question. Since a special advantage of the digitally controlled process comprises producing packages that contain individual identifiers, it is assumed herein that, according to the work file, the printing machine should produce an individual identifier for each individual printed workpiece. At stage 902, the printing machine prepares the printing of a specific individual printed workpiece.

At stage 903, the printing machine takes in a sheet and, at stage 904, measures the alignment of the sheet. At stage 905, the printing machine prints the desired prints on the sheet, whereby it becomes a printed workpiece. At stage 906, the printing machine delivers the printed workpiece forward in the process. The delivery stage 906 may include reading the identifier on the printed workpiece, whereby information about having forwarded such a printed workpiece is stored in the memory of the printing machine. The stages 901-906 are known as such in the digital printing machine technology.

The process that employs the centralized digital control differs from the conventional use of a mere digital printing machine in that the information collected at one stage of the process can be utilized at the other stages of the process even at an accuracy of a single workpiece. Part of the activity of the process can be based on what is called metainformation, which consists of information that forms during the handling of printed workpieces and is stored in electric form, and which in the memory of the digital control system that controls the arrangement unambiguously pertains to a specific printed workpiece or batch of workpieces. Being a concrete part of the printed workpiece, the individual identifier that is formed on the work-piece by the digital printing machine is not metainformation as such. Instead, examples of metainformation comprise the information that the digital printing machine can store at stages 907 and 908: It may store in its memory, e.g., information about the moment at which a printed workpiece identified by a specific identifier was produced, how its alignment at the printing stage succeeded, when it was forwarded from the printing machine, which larger work unity it belongs to, and even what kinds of ambient conditions (temperature, humidity, dust concentration, vibration etc.) prevailed at the moment of its production. In FIG. 9, it is assumed that the collected metainformation is stored in the digital control system in a centralized manner after the stage 908.

Another difference compared to the known digital printing machine technology, which uses batch processing for printing, is that the reading of input information described by the stage 901 may also include reading of supplementary input information, by which the digital control system directs the printing machine to produce substitute printed workpieces in place of those possibly produced earlier, which for one reason or another have not passed through the entire manufacturing process, as intended. For example, if a feeding failure occurs in the cutting machine, due to which some printed workpieces are ruined and it is not possible to cut proper packaging blanks from them, information about such packaging blanks (that are provided with individual identifiers) missing is formed at some reading stage of identifiers that pertains to the process, and may even circulate completely without the user's interaction through the digital control system to the printing machine, which automatically prints new ones to replace those.

At stage 911, the stacker receives information from the digital control system, concerning the size of stacks the printed workpieces should be stacked in and how their individual identifiers influence the stacking: e.g., workpieces provided with what kinds of identifiers should not be stacked in the same stack. When a specific printed workpiece is taken into the stacker at stage 912, its individual identifier is read at stage 913. On the basis of the identifier that was read and the input information received from the control system, a decision is made at stage 914 concerning the handling of the printed workpiece in question: should it be added to the stack being prepared or should a new stack be set up for it. Collecting the stack takes place at stage 915. The stage 916 describes the storage of workpiece-specific information in the stacker; this information may indicate, for example, when a specific printed workpiece identified by an individual identifier was transferred to the stack. When a stack according to the input information received earlier is ready, it is moved forward at stage 917.

In FIG. 9, it is assumed that the conveyor line is also under the direct control of the digital control system. This is not necessary, but the device, such as the stacker, which precedes the conveyor line in the process, can be programmed so that it emulates the module of the conveyor line, i.e., gives to the actual first module, through the same control information bus, the same control information as what the module would receive, if it was preceded by another module in the conveyor line. The stage 921 shown in FIG. 9 can be very simple. The digital control system may simply give a starting instructions to the first module of the conveyor line, when the control system has received the information from the stacker that a completed stack is successfully collected on the first conveyor module. In practice, the intake stage of the stack onto the conveyor line (stage 922) has now also been performed.

At stage 923, the conveyor line carries out the transfers and possible turns of the conveyed items, which are needed to transfer the items to be conveyed to the next section of the arrangement. It is assumed above that the conveyor modules of the modular conveyor line contain an integrated logic, which controls the mutual communication of the modules and takes care of the advance of the conveyance. Naturally, it is possible to separately connect each conveyor module to the centralized digital control system of the arrangement, which would then arrange the control of the modules, but this would cause more complications in the control functionality required of the control system and impair the scalability of the solution that includes changing the number of conveyor modules.

The conveyor line does not necessarily contain any information collection functionality. For the sake of completeness, however, it is assumed in FIG. 9 that, at stage 925, the conveyor line can collect information about the realized transfers and turns and even about the reading of workpiece- or stack-specific identifiers that was presented as stage 924. At stage 926, a specific stack has been conveyed through the conveyor line. Giving the related report to the digital control system is presented as stage 927, but the information about a successful conveyance can also come from the device following the conveyor line in the process, in a form, which indicates that it has read the identifiers of the printed workpieces, which according to the information obtained from the stacker earlier are stacked in a specific stack that was delivered to the conveyor line.

At stage 1001, the cutting machine receives input information from the digital control system, e.g., about how the individual identifier of a printed workpiece indicates, by which cutting tool (or according to which digitally-provided cutting instruction) it should be cut. At stage 1002, the cutting machine receives a stack from the conveyor line and picks from it the printed workpiece next in turn to be cut at stage 1003. Reading the identifier is presented as stage 1004 and, on the basis of this; a decision about handling the workpiece is made at stage 1005. For example, if cutting tools that are replaced by hand are used, which the cutting machine however automatically identifies, the decision at the stage 1005 may allow cutting right away, if the right tool is in use, or discontinue the operation and call the user to replace the tool with a proper cutting tool. The actual cutting is shown as stage 1006 and collecting the information that describes the handling of the said workpiece and delivering it to the digital control system as stage 1007. The cutting machine (as well as the other machines) may include several identifier-reading stages, if the intention is, e.g., to monitor and identify the workpieces coming into the machine, but to also ensure, which ones of them have successfully passed through the machine.

As an example, a situation is conceivable, wherein the intention is to produce N number of type a packages and M number of type b packages, wherein N and M are integers, and a and b merely names of the package types used herein. Each package receives an individual identifier. The identifiers of the first packages form a series a(1), a(2), a(3), . . . , a(N) and those of the second packages form a series b(1), b(2), b(3), . . . , b(M). At the first stage, the digital printing machine prints a sufficient number of workpieces in order to produce from them the required N number of type a packages. At the same time, the digital printing machine produces the identifiers a1, a2, a3, . . . , aN on the printed workpieces. All of this takes place by going around the working phases 901-908 of FIG. 9 for long enough. Thereafter, the digital printing machine starts to produce printed workpieces for the type b packages.

Let us assume that between the digital printing machine and the stacker, a failure occurs, as a consequence of which the printed workpieces fall off the process, which should have been used for manufacturing type a packages with the identifiers a(k), a(k+1), a(k+2), . . . , a(k+t), wherein k and t are integers and $(k+t) \leqq N$. Let us also assume that this takes place at such a late stage of printing the type a packages that the printing of type b packages has already started, when the consequences of the failure are discovered. When each printed workpiece arrives at the stacker, its identifier is read, corresponding to the stage 913. From the stage 916 and/or stage 918, information goes to the digital control system, indicating that given identifiers were lacking.

Depending on the way of programming the functions of the digital control system, it can correct the situation in various ways. In one example, the control system orders the stacker to stop stacking the printed workpieces that are related to the type a packages at stage 915, immediately after discovering that the following identifier that was read was not correct in sequence. The accumulated stack (the identifiers a(1), a(2), a(3), . . . , a(k−1)) is forwarded on the conveyor line and the rest of the printed workpieces (the identifiers a(k+t+1), a(k+t+2), a(k+t+3), . . . , a(N)) are stacked in a stack of their own. At stage 1001, the digital control system transmits information to the cutting machine, indicating that these two stacks should be cut in the manner of the type a packages and that, thereafter, a few type b packages are coming to be cut, and then again type a packages.

In the meantime, the digital control system, in the form of stage 901, has transmitted to the digital printing machine, a instructions to discontinue the production of printed workpieces for the type b packages and to reproduce the printed workpieces, from which the type a packages with the identifiers a(k), a(k+1), a(k+2), . . . , a(k+t) are manufactured. When the first one of these arrives at the stacker, the machine detects it at stage 913, stops stacking the printed workpieces, which have accumulated so far and which relate to the type b packages, at stage 915, and starts collecting a new stack of the printed workpieces related to the type a packages. Thus, the missing type a packages are manufactured quite automatically, and they merely come to the cutting machine slightly later than the others. Mixing the order can be avoided, if the conveyor line includes a "side track", which is parallel to the actual propagation path and onto which the conveyor line can transfer the stacks, which are collected in the right order as such to wait and after which one or more stacks of the printed workpieces that were missing from the previous order arrive. The final verification about a desired print succeeding is obtained by examining the information collected at stage 1007, indicating that all the desired identifiers on the packaging blanks coming out of the cutting machine have been read.

Figure 11:
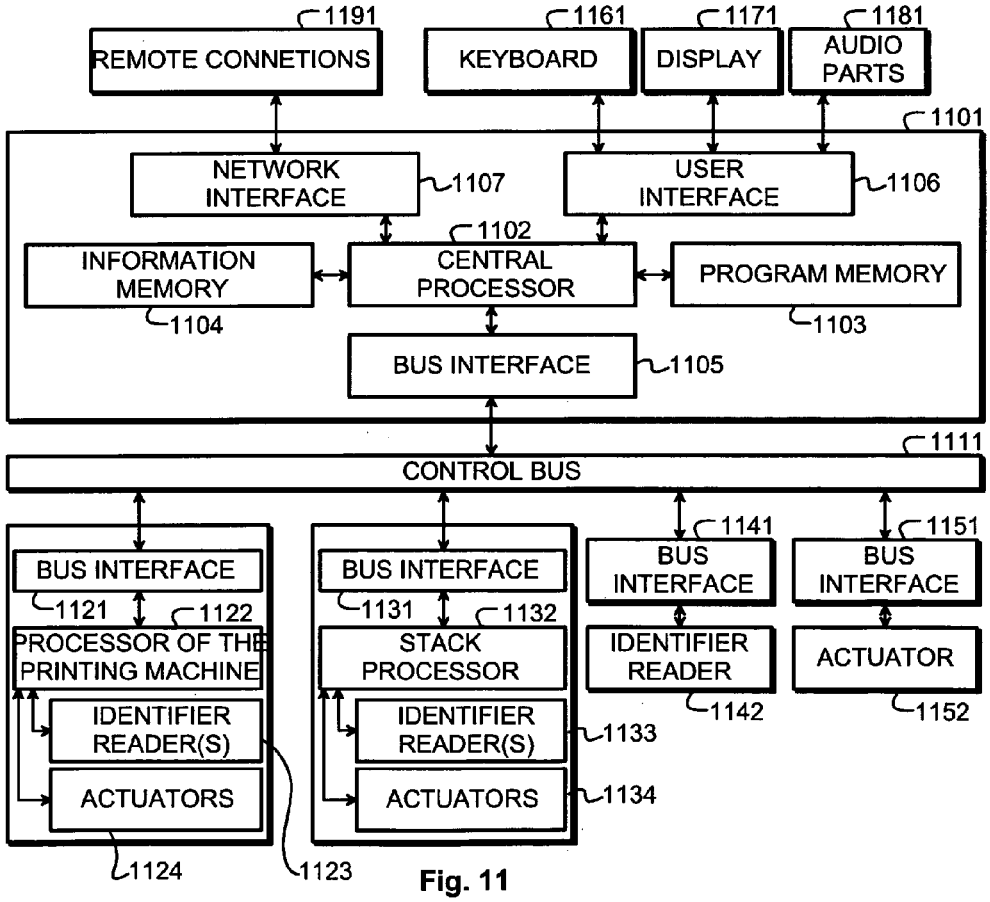
FIG. 11 shows components of a manufacturing arrangement of packages, which are involved in the digital control of the process.

FIG. 11 shows the parts of an arrangement according to an embodiment of the invention, e.g., the one in FIG. 2, which have a direct connection to the digital control of the process. The central processing part of the control system comprises the central processor 1102 of a control computer 1101, which is arranged to execute the programs stored in the program memory 1103 and to use the information memory 1104 for storing the information and reading the stored information. The central processor 1102 communicates through a bus interface 1105 with a control bus 1111, which forms an easy to scale information communications solution between the control computer 1101 and the devices that take care of the actual handling and manufacturing stages in the process.

For example, the digital printing machine has its own bus interface 1121 for a connection to the control bus 1111. The processor 1122 of the printing machine communicates, through the bus interface 1121 and the control bus 1111, with the control computer 1101 and, inside the digital printing machine, with possible identifier readers 1123 and actuators 1124 of the digital printing machine. The corresponding control functions are also found in the other digitally controlled machines of the process: An example shows the stacker that comprises a bus interface 1131, processor of the stacker 1132, identifier reader(s) 1133 and actuators 1134. The other corresponding devices may include the conveyor line, cutting machine, creasing machine etc. As typical control bus solutions easily support dozens or even hundreds of units connected to the same bus, an optional number of digitally controlled machines that have a similar control can be connected through the control bus 1111 to function under the control computer 1101.

FIG. 11 also shows how the single identifier readers 1142 and actuators 1152 can be connected to the control bus 1111 through their own bus interfaces 1141 and 1151. They have no programmable activity of their own, but they execute simple standard tasks only, such as reading the identifier on a workpiece passing by and reporting to the control computer, or switching on and off a function related to the process. For example, if the control architecture of any machine, which is used in the process and digitally controlled as such, does not support the integration of the identifier reader into the machine in a similar manner as the blocks 1123 and 1133 in FIG. 11, a separate identifier reader can be built in the machine in question or its environment, connecting directly to the control bus 1111. Irrespective of whether the identifier reader is part of a larger machine or a single device that is directly connected to the control bus 1111, all identifier readers are typically arranged to read an individual identifier that is earlier produced by the digital printing machine and transmit to the digital control system information about which identifier they have read.

For the user, the control computer 1101 comprises a user interface 1106 and the actual user equipment interfaced therewith, such as a keyboard 1161, display 1171 and audio parts 1181. The audio parts may include, e.g., acoustic signalling devices or earphones. According to an embodiment of the invention, a local sound reproducer, such as an MP3 player, can be integrated into the control computer. It can be implemented, for example, so that the required programs are stored in the program memory 1103, and by executing these programs, the central processor 1102 (or an auxiliary processor provided for the purpose) can process, store and reproduce the digital audio files that are stored in the information memory 1104. The sound to be produced is directed through the earphones that pertain to the audio parts 1181 for the user to listen. The user is offered a chance to influence the execution of the programs, such as the selection of the audio files to be reproduced, by the keyboard 1161. The display 1171 can display information that is related to the execution of programs in a similar manner as the MP3 players that are implemented as off-line equipment or parts of personal computers.

The recording and reproducing equipment of audio files that is integrated into the control computer can also be used for purposes other than reproducing music to entertain the worker who operates the machine. Various instructions related to the performance of work tasks and the control of the package manufacturing process can be stored in the audio files, which instructions the worker can selectively listen to in various situations, as needed. One possibility is to connect a wireless microphone to the audio parts 1181, which the user in a state of emergency can take near the part of process that is malfunctioning and store the noise it makes in the form of a digital audio file in the information memory 1104. When the machine repairer later on comes to the site, (s)he may make use of the stored audio files when troubleshooting the failure in question.

For remote control and a possibility for large-scale automation of the processes, the control computer 1101 is preferably provided with a network interface 1107, through which two-way remote connections 1191 are feasible.

Figure 12:
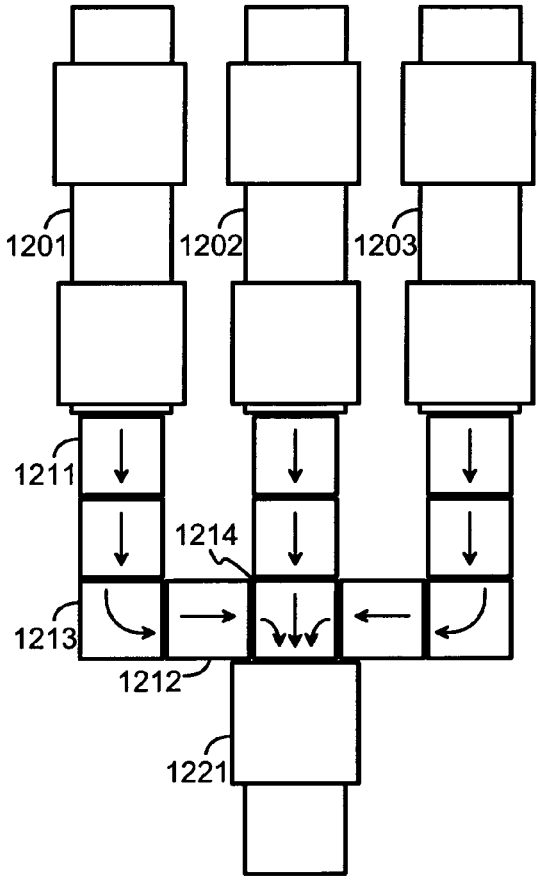
FIG. 12 shows an arrangement, wherein three printing machines share a common cutting machine.

FIG. 12 shows schematically a plan view of an arrangement, which exploits the difference in capacity; on the one hand, between digital printing machines 1201, 1202 and 1203 and, on the other hand, any subsequent process stage, such as the cutting machine 1221. The conveyor lines from the (stacking) tail of the digital printing machines 1201, 1202 and 1203 to the cutting machine form a complex, wherein the stacks can be moved forward by linearly transferring modules (e.g., modules 1211 and 1212), turned by 90 degrees by modules that turn in one direction (e.g., module 1213), or either moved linearly or turned by 90 degrees in either direction by multifunction modules (e.g., module 1214). The structure of the modules 1213 and 1214 may comply with the principle shown in FIG. 6. The originally three-way conveyor line is combined into one before the cutting machine 1221, whereby stacks of printed workpieces from any digital printing machine can be directed to the cutting machine. To direct the printed workpieces to the cutting machine in suitable turns as smoothly as possible, the entire arrangement is preferably built so as to be controlled by a common computer (not shown).

Figure 13:
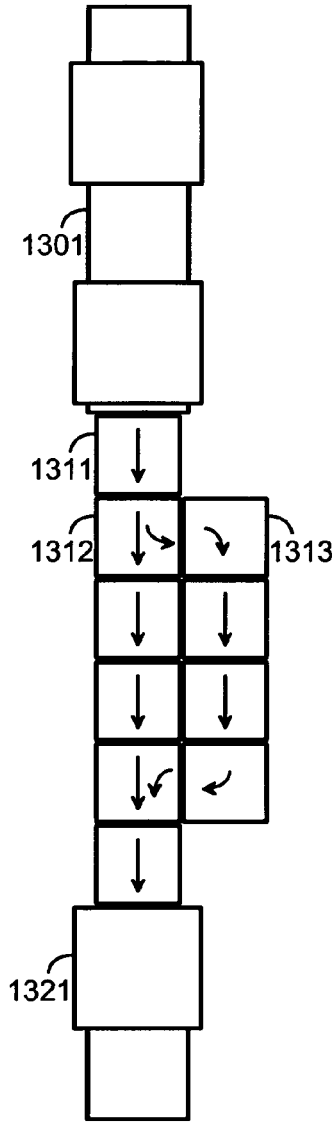
FIG. 13 shows an arrangement, wherein stacks can be guided past each other on the conveyor line.

FIG. 13 shows schematically a plan view of an arrangement, wherein the above-mentioned side track is built into the conveyor line. A conveyor line formed by modules leaves from the (stacking) tail of the digital printing machine 1301, which line may comprise linearly transferring modules (e.g., module 1311), modules that turn by 90 degrees (e.g., module 1313) and modules, which as needed either move the stack linearly or turn its direction of travel by 90 degrees to the side (e.g., module 1312). If one stack at a time fits on one module, in the arrangement according to FIG. 13, four stacks that are mutually in the right direction can be directed to wait on the side track, and a stack of printed workpieces that has been produced thereafter can be brought past them to the cutting machine 1321.

Only relatively short conveyor lines are dealt with above, their length from one machine to another comprising a few modules only. The invention does not limit the length of the conveyor line, i.e., the number of conveyor modules contained therein, if assembled from conveyor modules. For example, it should be taken into account that, for disturbance-free operation, the printing machine sets considerably stricter requirements for environmental factors (temperature, humidity, dustlessness, vibration etc.) than, e.g., the cutting machine. Therefore, it may be preferable to locate them in different rooms in the production area, whereby the conveyor line can be long enough to continue from one room to another, bypassing walls, columns and other obstacles, if necessary.

The invention claimed is:

1. An arrangement for manufacturing packages in a digitally controlled process, comprising:

a digital printing machine for producing printed workpieces;

a cutting machine for cutting packaging blanks from the printed workpieces (103);

a conveyor line for automatically transferring the printed workpieces to said cutting machine;

between said digital printing machine and said conveyor line a stacker, which is arranged to collect the printed workpieces in stacks and to deliver the collected stacks to said conveyor line; and a digital control system, which is arranged to transmit digital control data between at least said digital printing machine and said control system, to transmit digital control data between said cutting machine and said control system, and to transmit workpiece-specific information stored in the stacker between the stacker and said digital control system.

2. An arrangement according to claim 1, wherein at least one of said cutting machine and the stacker includes an identifier reader which is arranged to read an individual identifier that is produced by said digital printing machine on the printed workpiece that is handled in said cutting machine or the stacker, and to transmit to said digital control system information about which identifier it has read.

3. An arrangement according to claim 1, wherein said digital control system is arranged to store information about which identifiers produced by said digital printing machine have been read on the printed workpieces and/or packaging blanks handled by said system, according to the information obtained from identifier readers included in said system.

4. An arrangement according to claim 3, wherein said digital control system is arranged to store metainformation, which is formed during the handling of the printed workpieces and which in a memory of said digital control system unambiguously relates to a specific printed workpiece or batch of workpieces.

5. An arrangement according to claim 4, wherein said metainformation includes the information produced by said digital printing machine about the alignment in printing the printed workpiece.

6. An arrangement according to claim 3, wherein as a response to the information received from said identifier readers, indicating that a specific printed workpiece has not passed through the entire manufacturing process, said digital control system is arranged to control said digital printing machine to produce a substitute printed workpiece.

7. An arrangement according to claim 1, further comprising, between said digital printing machine and said cutting machine, a buffer stage, which is arranged to temporarily store the printed workpieces.

8. An arrangement according to claim 7, wherein as a response to stopping said cutting machine, said digital control system is arranged to transmit to the buffer stage a command to start temporarily storing the printed workpieces; and as a response to starting said cutting machine, said digital control system is arranged to transmit to the buffer stage a command to start feeding forward the temporarily stored printed workpieces.

9. An arrangement according to claim 1, wherein said conveyor line consists of subsequent conveyor modules, which are engaged to each other by detachable quick-release lockings and which are digitally controlled.

10. An arrangement according to claim 9, wherein the first conveyor module of said conveyor line is placed floatingly in the structures of the machine preceding said conveyor line; and the last conveyor module of said conveyor line is placed floatingly in the structures of the machine following said conveyor line.

11. An arrangement according to claim 9 or 10, wherein each conveyor module is arranged to exchange, with the other conveyor modules, data about the preparedness of the conveyor module to receive items that are to be conveyed and/or to forward the items that are to be conveyed.

12. An arrangement according to claim 1, wherein said digital control system comprises a control computer and an integrated recording and reproducing equipment of audio files.

13. A method of manufacturing packages in a digitally controlled process, comprising:

producing printed workpieces by a digital printing machine;

collecting the printed workpieces in stacks in a stacker and delivering the collected stacks to a conveyor line conveying the collected stacks automatically to a cutting machine;

cutting packaging blanks from the printed workpieces;

transmitting digital control data between said digital printing machine and said control system and between the cutting machine and said control system, and transmitting workpiece-specific information stored in the stacker between stacker and said digital control system.

14. A method according to claim 13, wherein at a specific handling stage of the printed workpieces after said digital printing machine, an identifier produced by said digital printing machine on the printed workpiece is machine-read, and information about which identifier was read is reported to said control system.

15. A method according to claim 14, wherein as a response to the information obtained by machine-reading the identifier, indicating that a specific printed workpiece has not passed through the entire manufacturing process, said digital printing machine is directed to produce a substitute printed workpiece.

16. A method according to any of claim 13, further comprising storing metainformation, which is formed during the handling of printed workpieces and which in the memory of said digital control system unambiguously relates to a specific printed workpiece or batch of workpieces.

* * * * *

UNITED STATES PATENT AND TRADEMARK OFFICE

CERTIFICATE OF CORRECTION

PATENT NO. : 8,493,421 B2
APPLICATION NO. : 12/989332
DATED : July 23, 2013
INVENTOR(S) : Pettersson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 331 days.

Signed and Sealed this
Eighth Day of September, 2015

Michelle K. Lee

Michelle K. Lee
*Director of the United States Patent and Trademark Office*